US005882188A

United States Patent [19]

Eriksson

[11] Patent Number: 5,882,188

[45] Date of Patent: Mar. 16, 1999

[54] GAS BURNER PROVIDED WITH IGNITION DEVICES

[75] Inventor: Ake Eriksson, Upplands Väsby, Sweden

[73] Assignee: Primus AB, Solna, Sweden

[21] Appl. No.: 73,270

[22] Filed: May 5, 1998

[51] Int. Cl.[6] ..... F23Q 3/00

[52] U.S. Cl. ..... 431/264; 431/258

[58] Field of Search ..... 431/258, 264, 431/255

[56] References Cited

U.S. PATENT DOCUMENTS

| | | | |
|---|---|---|---|
| 2,460,016 | 1/1949 | Kuhn | 431/192 |
| 3,299,941 | 1/1967 | Frick | 431/192 |
| 4,826,427 | 5/1989 | Hyde | 431/264 |

OTHER PUBLICATIONS

WO94/27091, PCT/RU93/00115, Class 431, sub. 264, Nov. 1994.

*Primary Examiner*—Carroll B. Dority
*Attorney, Agent, or Firm*—Levisohn, Lerner, Berger & Langsam

[57] ABSTRACT

A gas burner includes an ignition mechanism and a gas conduit for conducting gas from a gas supply, through a gas inlet, to a burner nozzle. The gas conduit includes an ignition gas conduit and a separate main gas conduit, the ignition and main gas conduit being generally parallel to each other with the main gas conduit being disposed within the ignition gas conduit. The gas inlet, at one end of the gas conduit, is in communication with the ignition gas conduit, through an ignition nozzle. The ignition mechanism is mounted in the ignition gas conduit, downstream of the ignition nozzle. The main gas conduit is in communication with the ignition gas conduit through the burner nozzle. The burner nozzle is located downstream of the ignition mechanism.

20 Claims, 2 Drawing Sheets

GAS BURNER PROVIDED WITH IGNITION DEVICES

BACKGROUND OF THE INVENTION AND BRIEF DESCRIPTION OF THE PRIOR ART

According to a first aspect, the present invention relates to a gas burner of the kind defined in the preamble of claim 1, and according to a second aspect relates to a method of igniting a gas burner.

Gas burners of this kind have many different applications, among these being soldering, seam-welding, heating, drying, shrinking or burning applications. The burner unit will at times have a considerable size, such as in the case of roof burners, which causes difficulties in igniting the flame. Furthermore, positioning of the igniter or spark plug adjacent the burner nozzle requires the provision of a long cable to the igniter, therewith causing difficulties. The presence of a pilot flame that burns during rest periods which is located in the vicinity of the burner nozzle and functions to ignite the full flame is also disadvantageous, for instance with respect to heat development during rest periods and unnecessary gas consumption.

SUMMARY OF THE INVENTION

Accordingly, the object of the present invention is to provide a gas burner of the kind in question with which flame ignition is effected in the absence of the aforesaid drawbacks.

This object is achieved in accordance with the invention with a gas burner of the kind defined in the preamble of claim 1 and having the features set forth in the characterizing clause of said claim, and with a method of the kind defined in the preamble of claim 8 and comprising the particular method steps set forth in the characterizing clause of said claim.

By igniting a gas burner in two stages in this way, the function of initially igniting the burner is separated from the function of maintaining the burner ignited. The separately arranged ignition gas flow can be adapted with respect to dimensions and flow rate to facilitate precisely this facility, and makes possible optimal localization of the ignition function. The unit can be ignited easily without requiring unnecessarily complicated devices and without requiring a primary flame that burns during rest periods.

The ignition device is preferably a spark plug which is positioned advantageously relatively far upstream in the ignition gas conduit, i.e. close to the ignition nozzle. This means that only a short cable is required and that ignition will be less sensitive to disturbances.

The ignition gas conduit will preferably have a larger throughflow area than the main gas conduit, which is preferably located within the first-mentioned. This results in a lower gas flow rate in the ignition gas conduit, therewith facilitating ignition. A further contribution in this respect is obtained by arranging the nozzle areas so that a relatively small part of the gas will flow through the ignition gas conduit.

These and other advantageous embodiments of the inventive gas burner will be evident from the depending claims.

BRIEF DESCRIPTION OF THE DRAWINGS

The invention will now be described in more detail with reference to a preferred embodiment thereof and also with reference to the accompanying drawings, in which.

DETAILED DESCRIPTION OF THE DRAWINGS AND PREFERRED EMBODIMENT

Figure 1:
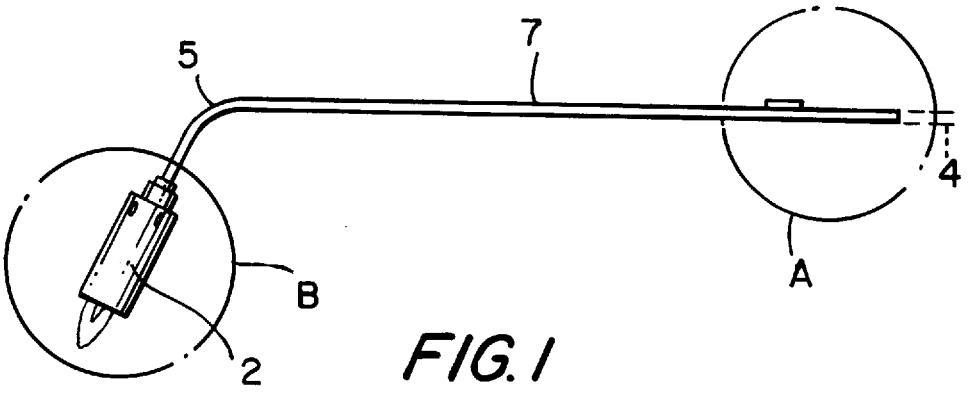
FIG. 1 is a schematic side view of an inventive gas burner with a flame being schematically shown.

The gas burner illustrated in FIG. 1 includes a conduit means 1 whose one end is connected to a gas delivery conduit 4 said gas being a mixture of butane/propane for instance, and whose other end is fitted with a working flame holder 2. The illustrated gas burner is a so-called roof burner and its conduit 1 includes a bend 5 of 45° to 60° in the proximity of the flame holder 2, such as to enable the tool to be handled comfortably and expediently.

Figure 2:
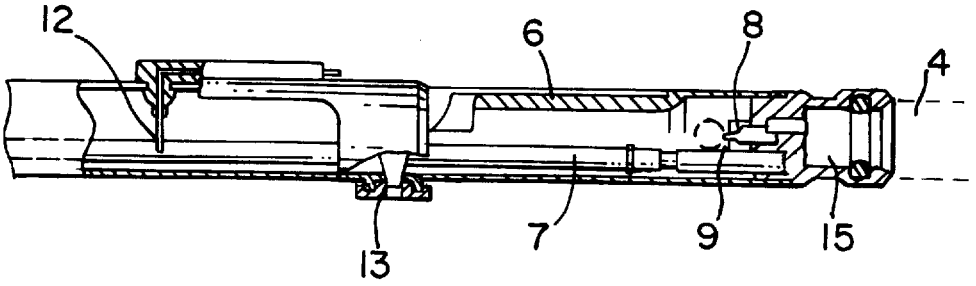
FIG. 2 is a partially sectioned longitudinal view of the detail A shown in FIG. 1.
Figure 3:
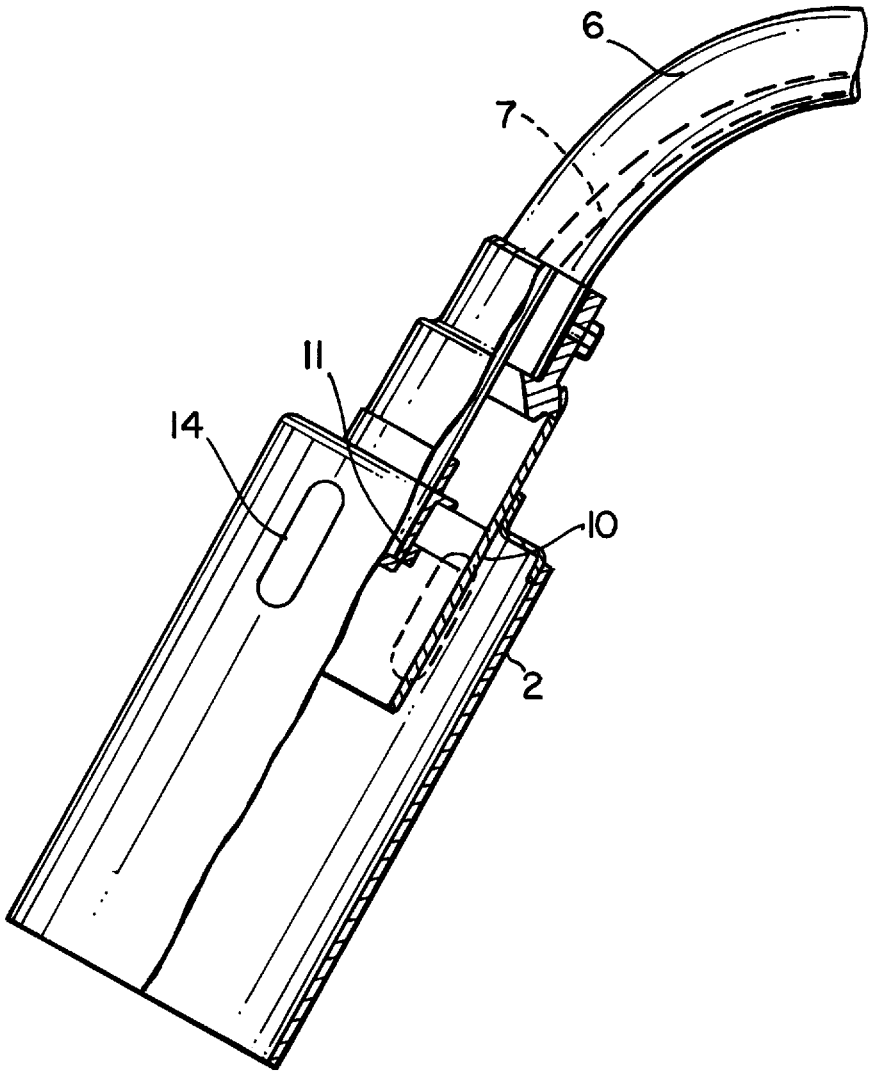
FIG. 3 is a partially sectioned longitudinal view of the detail B shown in FIG. 2.

As evident from FIGS. 2 and 3, the conduit means 1 includes an outer gas tube 6 and a gas tube 7 arranged within said outer tube. Both tubes extend essentially along the whole of the unit and the outer tube is intended for producing an ignition flame whereas the inner tube 7 delivers gas to the main flame. As will be seen from the drawings, the ignition flame tube 6 has a much larger throughflow area than the main flame tube 7. FIG. 2 is illustrates the manner in which the ignition flame tube 6 communicates through an ignition nozzle 8 with a gas inlet 15 connected to the gas delivery conduit 4. The main flame tube 7 is in direct open communication with the gas inlet 15. The ignition flame tube 6 includes a first array of primary air holes 9 disposed close to the ignition nozzle 8 and downstream thereof.

At the other end of the unit (FIG. 3), the ignition flame tube 6 opens into an ignition flame holder 10, which in turn opens into a main flame holder 2. The ignition flame holder 10 extends slightly into the main flame holder 2 and is generally concentrical therewith. The main flame tube 7 opens into the ignition flame holder 10 through the medium of a main flame burner nozzle 11 whose through flow area is much greater than the throughflow low area of the ignition nozzle 8. The main flame holder 2 has a second array of primary air holes 14 disposed in that part of the main flame holder 2 within which the ignition flame holder 10 is located.

As will be evident from FIG. 2, an ignition plug 12 is provided in the ignition flame tube 6 and is activated piezoelectrically by means of an actuator 13. The ignition plug 12 is located relatively close to the ignition nozzle 8, preferably at a distance therefrom which is less than one-fifth of the distance between the ignition plug 12 and the burner nozzle 11.

A minor part of the gas from the delivery conduit 4 flows from the gas inlet 15 through the ignition nozzle B and out into the ignition flame tube 6, whereas the major part of the gas flows through the main flame tube 7 and out through the main flame burner nozzle 11. The gas flow through the ignition flame tube 6 will therefore be relatively small and, because of its large cross-sectional area in relation to the cross-sectional area of the main frame tube, the rate of gas flow in the ignition flame tube 6 will be relatively small.

The gas admixes with air sucked in through the primary air holes 9 and flows past the ignition plug 12 and is there ignited by the spark generated when activating the plug, so as to generate a flame puff which moves forwardly in the ignition flame tube 6 from the spark plug 12 towards the burner nozzle 11 at the downstream end of the unit. Gas ignition in the ignition flame tube 6 is facilitated by the low rate of gas flow. As the flame puff or ignition flame reaches the ignition flame holder 10, the flame ignites the gas that flows out into the ignition flame holder 10 from the main flame tube 7 through the main flame burner nozzle 11. The gas burner main flame is therewith ignited and the unit ready for use. The gas flow is cut-off completely when work stops There is no primary flame that burns during rest periods, so as to develop heat and consume gas during these periods.

Although the gas burner has been described with reference to its use as a roof burner, it will be understood that the invention can be applied with many other types of gas burner and that it affords a particular advantage when used with units of large dimensions.

I claim:

1. A gas burner that includes ignition means and gas conduit means for conducting gas from a gas inlet provided at one end of the gas conduit means to a burner nozzle provided at the other end of said gas conduit means, characterized in that said gas conduit means includes an ignition gas conduit and a main conduit, said conduits being generally parallel with one another;

said gas inlet being in communication with said ignition gas conduit through the medium of an ignition nozzle;

said ignition means being mounted in said ignition gas conduit downstream of said ignition nozzle;

said main gas conduit being in communication with said ignition gas conduit through the medium of said burner nozzle;

said burner nozzle being located downstream of said ignition means; and said main gas conduit being disposed within said ignition gas conduit.

2. A gas burner according to claim 1, wherein said ignition means is a sparking plug.

3. A gas burner as claimed in claim 1, further comprising a first air inlet means in the proximity of said ignition nozzle, and a second air inlet means in the proximity of said burner nozzle.

4. A gas burner as claimed in claim 1, wherein the distance between said ignition nozzle and said ignition means is less than half the distance between said ignition means and said burner nozzle.

5. A gas burner as claimed in claim 1, wherein the throughflow area of the burner nozzle is one or more multiples larger than the throughflow area of the ignition nozzle.

6. A gas burner as claimed in claim 1, wherein the throughflow area of the ignition gas conduit is one or more multiples larger than the throughflow area of the main gas conduit.

7. A gas burner as claimed in claim 3, wherein the distance between said ignition nozzle and said ignition means is less than half the distance between said ignition means and said burner nozzle.

8. A gas burner as claimed in claim 1, wherein the distance between said ignition nozzle and said ignition means is about one fifth the distance between said ignition means and said burner nozzle.

9. A gas burner as claimed in claim 3, wherein the distance between said ignition nozzle and said ignition means is about one fifth the distance between said ignition means and said burner nozzle.

10. A gas burner as claimed in claim 3, wherein the throughflow area of the burner nozzle is one or more multiples larger than the throughflow area of the ignition nozzle.

11. A gas burner as claimed in claim 4, wherein the throughflow area of the burner nozzle is one or more multiples larger than the throughflow area of the ignition nozzle.

12. A gas burner as claimed in claim 7, wherein the throughflow area of the burner nozzle is one or more multiples larger than the throughflow area of the ignition nozzle.

13. A gas burner as claimed in claim 8, wherein the throughflow area of the burner nozzle is one or more multiples larger than the throughflow area of the ignition nozzle.

14. A gas burner as claimed in claim 9, wherein the throughflow area of the burner nozzle is one or more multiples larger than the throughflow area of the ignition nozzle.

15. A gas burner as claimed in claim 3, wherein the throughflow area of the ignition gas conduit is one or more multiples larger than the throughflow area of the main gas conduit.

16. A gas burner as claimed in claim 4, wherein the throughflow area of the ignition gas conduit is one or more multiples larger than the throughflow area of the main gas conduit.

17. A gas burner as claimed in claim 7, wherein the throughflow area of the ignition gas conduit is one or more multiples larger than the throughflow area of the main gas conduit.

18. A gas burner as claimed in claim 8, wherein the throughflow area of the ignition gas conduit is one or more multiples larger than the throughflow area of the main gas conduit.

19. A gas burner as claimed in claim 9, wherein the throughflow area of the ignition gas conduit is one or more multiples larger than the throughflow area of the main gas conduit.

20. A gas burner as claimed in claim 10, wherein the throughflow area of the ignition gas conduit is one or more multiples larger than the throughflow area of the main gas conduit.

* * * * *